US010300621B2

(12) United States Patent
Ootsubo et al.

(10) Patent No.: US 10,300,621 B2
(45) Date of Patent: May 28, 2019

(54) METHOD FOR PRODUCING CUT BODIES AND METHOD FOR CUTTING FIBER-REINFORCED RESIN

(71) Applicant: Teijin Limited, Osaka-shi, Osaka (JP)

(72) Inventors: Makoto Ootsubo, Osaka (JP); Hiroya Hada, Osaka (JP); Toshiki Maeda, Osaka (JP); Takuo Kanzaki, Osaka (JP)

(73) Assignee: Teijin Limited, Osaka-Shi, Osaka (JP)

( * ) Notice: Subject to any disclaimer, the term of this patent is extended or adjusted under 35 U.S.C. 154(b) by 234 days.

(21) Appl. No.: 14/838,968

(22) Filed: Aug. 28, 2015

(65) Prior Publication Data

US 2016/0059432 A1 Mar. 3, 2016

(30) Foreign Application Priority Data

Aug. 28, 2014 (JP) ..... 2014-174126

(51) Int. Cl.
*B26D 7/10* (2006.01)

(52) U.S. Cl.
CPC ..... *B26D 7/10* (2013.01); *Y10T 83/041* (2015.04); *Y10T 83/0414* (2015.04)

(58) Field of Classification Search
CPC . B26D 7/10; B26D 7/086; B23P 25/00; B23P 25/003; Y10T 83/0405; Y10T 83/041; Y10T 83/0414; Y10T 83/283; Y10T 83/293
USPC ..... 83/14–16, 170, 171; 264/145, 148–151
See application file for complete search history.

(56) References Cited

U.S. PATENT DOCUMENTS

| | | | | |
|---|---|---|---|---|
| 8,104,385 | B2 * | 1/2012 | Hayashi et al. | C03B 33/033 219/121.67 |
| 2005/0120842 | A1 | 6/2005 | Kawasaki et al. | |
| 2010/0028593 | A1 * | 2/2010 | Taketa et al. | B29C 43/222 428/113 |
| 2010/0120987 | A1 * | 5/2010 | Oomori et al. | C08J 5/046 525/286 |
| 2013/0274413 | A1 * | 10/2013 | Ozeki et al. | C08J 5/042 524/611 |
| 2013/0280479 | A1 * | 10/2013 | Okada et al. | C08J 5/042 428/114 |

(Continued)

FOREIGN PATENT DOCUMENTS

| | | |
|---|---|---|
| JP | S61-095900 | 5/1986 |
| JP | 2002-363253 A | 12/2002 |

(Continued)

OTHER PUBLICATIONS

Feb. 5, 2019—(JP) Office Action—App 2015155044 (with machine translation).

*Primary Examiner* — Clark F Dexter
(74) *Attorney, Agent, or Firm* — Banner & Witcoff, Ltd.

(57) ABSTRACT

According to an aspect of the present invention, there is provided a method for producing cut bodies including: cutting a fiber-reinforced resin material, the fiber-reinforced resin material including reinforcing fibers and a thermoplastic resin, the reinforcing fibers having a tensile strength of 1,000 MPa to 6,000 MPa; and heating the fiber-reinforced resin material, wherein a flexural modulus of the fiber-reinforced resin material at the cutting is decreased to a value ranging from 80% to 15% of the flexural modulus of the fiber-reinforced resin material before heating.

8 Claims, 2 Drawing Sheets

(56) References Cited

U.S. PATENT DOCUMENTS

| | | | | |
|---|---|---|---|---|
| 2013/0295811 | A1* | 11/2013 | Shinmen et al. | D01D 5/253 442/192 |
| 2013/0309442 | A1* | 11/2013 | Ruby et al. | B62D 25/00 428/109 |
| 2013/0317161 | A1* | 11/2013 | Konagai et al. | B29C 70/12 524/495 |
| 2013/0344282 | A1* | 12/2013 | Yagi et al. | B29C 70/10 428/113 |
| 2014/0004308 | A1* | 1/2014 | Taniguchi et al. | C08J 5/04 428/156 |
| 2014/0039114 | A1* | 2/2014 | Hagihara et al. | B29C 43/222 524/495 |
| 2014/0191437 | A1* | 7/2014 | Johnson et al. | B29C 47/14 264/171.13 |
| 2014/0212650 | A1* | 7/2014 | Johnson et al. | B29C 70/523 428/300.1 |
| 2014/0234600 | A1* | 8/2014 | Wang et al. | B32B 5/022 428/212 |
| 2015/0273813 | A1* | 10/2015 | Yasuda | B32B 38/04 83/16 |

FOREIGN PATENT DOCUMENTS

| | | | |
|---|---|---|---|
| JP | 2005-161503 | A | 6/2005 |
| JP | 2009-172753 | A | 8/2009 |
| JP | 2011-084038 | A | 4/2011 |
| JP | 2013-091128 | A | 5/2013 |
| JP | 2014-015594 | A | 1/2014 |
| JP | 2014-095034 | A | 5/2014 |
| WO | WO 89/02004 | * | 3/1989 |

* cited by examiner

METHOD FOR PRODUCING CUT BODIES AND METHOD FOR CUTTING FIBER-REINFORCED RESIN

CROSS-REFERENCE TO RELATED APPLICATION(S)

This application is based on and claims priority under 35 U.S.C. 119 from Japanese Patent Application No. 2014-174126 filed on Aug. 28, 2014, the entire disclosures of which are incorporated by reference.

BACKGROUND

1. Technical Field

The present invention relates to a method for producing cut bodies and a method for cutting a fiber-reinforced resin material including reinforcing fibers and a thermoplastic resin.

2. Background Art

In recent years, so-called fiber-reinforced resin materials including a matrix resin and reinforcing fibers such as carbon fibers have attracted attention in the machine field. These fiber-reinforced resin materials are excellent in tensile modulus, tensile strength, impact resistance and the like, because reinforcing fibers are dispersed in the matrix resin, and have been studied to be used in structural members and the like of automobiles and the like. These fiber-reinforced resin materials can be formed into desired forms by using injection molding, compression molding and the like.

In general, a fiber-reinforced resin is excellent in mechanical strength compared to a general-purpose resin, and therefore machining thereof tends to become difficult. In particular, durability of a processing blade is significantly reduced in many cases, compared to the general-purpose resin. This has been one of the factors for inhibiting mass production of a product including the fiber-reinforced resin. Further, as a method of using no processing blade, there is a water jet, laser cutting or the like. However, considering mass production, there is difficulty in cost and processing time.

In JP-A-2013-91128, as a technique for efficiently cutting a fiber-reinforced resin material, it is proposed to use carbon steel for a Thomson blade and to increase hardness by quenching. Although an effect is seen in improvement of durability by the increase in hardness, workability of the blade is deteriorated, and it becomes difficult for the blade to be a large size or to have various shapes.

In JP-A-61-95900, there is described a method for cutting a fiber-reinforced plastic product, in which when the fiber-reinforced plastic product is scrapped, cutting is performed by a high-pressure water jet in a state where the fiber-reinforced plastic product is previously softened by heating with a combustion gas.

In JP-A-2009-172753, there is described a processing method for obtaining a fiber-reinforced resin shaped article having high dimensional accuracy and a small burr generation amount of reinforcing fibers at an end surface of the shaped article, with respect to punching of a fiber-reinforced resin shaped plate.

However, according to the method described in JP-A-2013-91128, it is necessary to allow the Thomson blade to have excessive hardness, so that a blade edge thereof might be broken.

Further, the resin used in the fiber-reinforced plastic of JP-A-61-95900 is a thermosetting resin, so that the resin is sublimated even when subjected to excessive gas flames. However, when a thermoplastic resin is used as a resin, the resin is softened and melted before sublimation, and it is impossible to cut an appropriate portion. In particular, when carbon fibers are used as fibers, a heated region is increased due to good thermal conductivity, and the periphery thereof is excessively heated and deteriorated as a result thereof. Accordingly, a portion that can be effectively utilized is decreased, which further causes a problem.

Furthermore, in the processing of the fiber-reinforced resin shaped plate in JP-A-2009-172753, it is necessary to punch the same place repeatedly twice or more, which increases the number of cutting steps. It is therefore difficult to continuously obtain cut bodies.

An object of the present invention is to provide a method for producing cut bodies, which efficiently cuts a fiber-reinforced resin material and prolongs durability of a cutting blade to produce the cut bodies, and an excellent method for cutting a fiber-reinforced resin material.

In order to improve durability of a cutting blade in a cutting method of a fiber-reinforced resin material including reinforcing fibers and a thermoplastic resin, the present inventors have made intensive studies. As a result, it has been found that it is possible to obtain a desired producing method and cutting method by controlling the flexural modulus at the cutting of a fiber-reinforced resin, thus leading to the present invention.

SUMMARY

Specifically, an aspect of the present invention is as follows.

[1] A method for producing cut bodies including: cutting a fiber-reinforced resin material including reinforcing fibers having a tensile strength of 1,000 MPa to 6,000 MPa and a thermoplastic resin, wherein a flexural modulus of the fiber-reinforced resin material is decreased to 80% to 15% at the cutting.

[2] The method for producing cut bodies according to [1], wherein the cutting is performed on a cutting table.

[3] The method for producing cut bodies according to [2], wherein the flexural modulus of the fiber-reinforced resin material is decreased to 80% to 15% at the cutting by heating the fiber-reinforced resin material, wherein the fiber-reinforced resin material is heated to a temperature which is 150° C. lower than a melting point to a temperature which is 50° C. lower than the melting point when the thermoplastic resin is a crystalline resin, or to a temperature which is 50° C. lower than a glass transition point to a temperature which is 50° C. higher than the glass transition point when the thermoplastic resin is an amorphous resin.

[4] The method for producing cut bodies according to [3], wherein the fiber-reinforced resin material contains 0.2 to 20% by weight of a black pigment, and the the fiber-reinforced resin material is performed by infrared heating.

[5] The method for producing cut bodies according to [3] or [4], wherein a temperature of the fiber-reinforced resin material at the cutting is substantially constant.

[6] The method for producing cut bodies according to [3], wherein at least a part of the reinforcing fibers is a fiber bundle form.

[7] The method for producing cut bodies according to [3], wherein the reinforcing fibers have an average fiber length of 1 mm to 100 mm.

[8] The method for producing cut bodies according to [3], wherein the reinforcing fibers are carbon fibers.

[9] The method for producing cut bodies according to [3], wherein a volume fraction (Vf) of the reinforcing fibers in the fiber-reinforced resin material, which is defined by formula (1), is from 5% to 80%, wherein formula (1) is:

$$Vf=100*\text{reinforcing fiber volume}/(\text{reinforcing fiber volume}+\text{thermoplastic resin volume}).$$

[10] A method for cutting a fiber-reinforced resin material including reinforcing fibers having a tensile strength of 1,000 to 6,000 MPa and a thermoplastic resin, wherein a flexural modulus of the fiber-reinforced resin material is decreased to 80% to 15% at the cutting.

According to a method for producing cut bodies of an aspect of the present invention, durability of a cutting blade can be improved by adjusting the flexural modulus of a fiber-reinforced resin material as an object to be cut, and the cut bodies can be obtained by continuously cutting the fiber-reinforced resin material.

BRIEF DESCRIPTION OF THE DRAWINGS

The present disclosure is illustrated by way of example and not limited in the accompanying figures in which like reference numerals indicate similar elements and in which.

DETAILED DESCRIPTION

Figure 1:
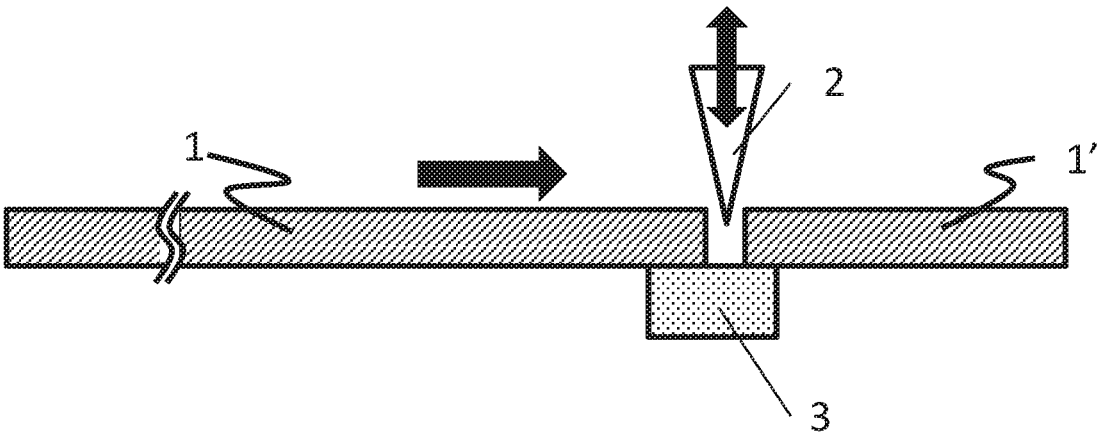
FIG. 1 is a schematic illustration of a method for producing cut bodies using a cutting table and reciprocating blade in accordance with one aspect.

Embodiments of an aspect of the present invention will be described below in turn.

[Adjustment of Flexural Modulus of Fiber-Reinforced Resin Material]

In a method for producing cut bodies of an aspect of the present invention, the cut bodies are obtained by cutting a fiber-reinforced resin material including reinforcing fibers having a tensile strength of 1,000 MPa to 6,000 MPa and a thermoplastic resin, wherein the flexural modulus of the fiber-reinforced resin material is decreased to 80% to 15% at the cutting.

The fiber-reinforced resin material including reinforcing fibers having a tensile strength of 1,000 MPa to 6,000 MPa and a thermoplastic resin is excellent in mechanical strength, because it is fiber-reinforced. On the other hand, it has a high flexural modulus, so that when the fiber-reinforced resin material is cut using a cutting blade, large cutting resistance is applied to the cutting blade so that a tip of the cutting blade tends to be easily worn away. The present inventors have found that wear of the cutting blade is decreased by decreasing the flexural modulus of the fiber-reinforced resin material to 80% to 15% at the cutting so as to reduce the cutting resistance that the fiber-reinforced resin material has at the cutting.

When the flexural modulus of the fiber-reinforced resin material cannot be decreased to 80%, an effect of prolonging a life of the cutting blade is not sufficient. On contrary, when the flexural modulus of the fiber-reinforced resin is decreased to less than 15%, the reinforcing fibers contained in the fiber-reinforced resin material flow without being fixed to the resin. Accordingly, a burr is generated on a cut surface, or the fiber-reinforced resin material is too soft to be cut.

The ratio of decrease in the flexural modulus of the fiber-reinforced resin material is preferably from 80% to 30%, more preferably from 75% to 35%, and still more preferably from 70% to 40%.

As a means for decreasing the flexural modulus of the fiber-reinforced resin material to 80% to 15%, there is no particular limitation. However, specifically, there is a heating the fiber-reinforced resin material to a temperature which is 150° C. lower than a melting point to a temperature which is 50° C. lower than the melting point when the thermoplastic resin is a crystalline resin, or to a temperature which is 50° C. lower than a glass transition point to a temperature which is 50° C. higher than the glass transition point when the thermoplastic resin is an amorphous resin.

As another means for decreasing the flexural modulus, there is a heating the cutting blade to a temperature which is 150° C. lower than a melting point to a temperature which is 50° C. lower than the melting point when the thermoplastic resin is a crystalline resin, or to a temperature which is 50° C. lower than a glass transition point to a temperature which is 50° C. higher than the glass transition point when the thermoplastic resin is an amorphous resin. At the cutting of the fiber-reinforced resin material, the fiber-reinforced resin material can be locally heated by heating the cutting blade.

Still another means for decreasing the flexural modulus also includes a humidity-controlling the fiber-reinforced resin material. In particular, when the thermoplastic resin used is a polyamide, the flexural modulus of the fiber-reinforced resin material can be appropriately decreased by moisture absorption of the polyamide.

Of these means for decreasing the flexural modulus, the heating of the fiber-reinforced resin material or the heating of the cutting blade can be preferably used in mass production.

Meanwhile, in a method for calculating the ratio (%) of decrease in the flexural modulus of the fiber-reinforced resin material in the present invention, the flexural modulus of the fiber-reinforced resin material after the flexural modulus is decreased is divided by the value before the flexural modulus is decreased.

When the decreasing of the flexural modulus is performed by heating of the fiber-reinforced resin material, in a specific method for calculating the ratio (%) of decrease in the flexural modulus, the flexural modulus of the fiber-reinforced resin material after heating is divided by the value of the flexural modulus of the fiber-reinforced resin material before heating.

(Heating Means)

When the fiber-reinforced resin material is heated, there is no particular limitation on a heating method, and it is possible to use any method. Specifically, there are exemplified a method of using a hot-air dryer or an electric heating type dryer, a method of using saturated steam or superheated steam, a method of sandwiching between hot plates in a mold, a belt conveyer, a hot roller or the like, dielectric heating due to infrared rays, far-infrared rays, microwaves, high-frequency waves or the like and induction heating (IH).

(Temperature of Fiber-Reinforced Resin Material at the Cutting)

When the fiber-reinforced resin material is heated, there is no particular limitation on changes in temperature of the fiber-reinforced resin material at the cutting. However, it is preferred that the temperature of the fiber-reinforced resin material at the cutting is substantially constant.

The term "substantially constant" as used herein means that a large decrease in temperature does not occur just before and just after cutting of the fiber-reinforced resin material, and it may be within a range of approximately ±20° C. When the temperature is substantially constant, the fiber-reinforced resin material can be stably continuously cut. In cutting of the fiber-reinforced resin material such as burr removal at the time of hot pressing or cold pressing, which generates a large change in temperature after heating of the fiber-reinforced resin material, the temperature is not substantially constant, so that the fiber-reinforced resin material cannot be continuously cut.

[Fiber-Reinforced Resin Material]

The fiber-reinforced resin material used in an aspect of the present invention is a material including reinforcing fibers and a thermoplastic resin.

(Thickness of Fiber-Reinforced Resin Material)

Although the thickness of the fiber-reinforced resin material is not particularly limited, it is usually preferably within a range of 0.01 mm to 100 mm, preferably within a range of 0.01 mm to 5 mm, and more preferably within a range of 1 to 3 mm. When the fiber-reinforced resin material has a constitution in which a plurality of layers are layered, the above-mentioned thickness does not indicate the thickness of each layer, but shall be considered to indicate the thickness of the whole fiber-reinforced resin material obtained by totaling the thicknesses of the respective layers.

[Reinforcing Fibers]

The kind of reinforcing fibers used in an aspect of the present invention can be appropriately selected depending on the kind of thermoplastic resin, the use of the fiber-reinforced resin material and the like, and is not particularly limited. For this reason, either inorganic fibers or organic fibers can be suitably used as the reinforcing fibers used in an aspect of the present invention. The above-mentioned inorganic fibers include, for example, carbon fibers, activated carbon fibers, graphite fibers, glass fibers, tungsten carbide fibers, silicon carbide fibers, ceramic fibers, alumina fibers, natural fibers, mineral fibers such as basalt, boron fibers, boron nitride fibers, boron carbide fibers, metal fibers and the like.

The above-mentioned metal fibers include, for example, aluminum fibers, copper fibers, brass fibers, stainless steel fibers and steel fibers.

The above-mentioned glass fibers include ones constituted by E glass, C glass, S glass, D glass, T glass, quartz glass fibers, borosilicate glass fibers and the like.

The above-mentioned organic fibers include, for example, fibers constituted by resin materials such as polyaramid, PBO (poly(p-phenylenebenzoxazole)), polyphenylene sulfide, polyester, acrylic resin, polyamide, polyolefin, polyvinyl alcohol and polyarylate.

In the present invention, two or more kinds of reinforcing fibers may be used together. In this case, plural kinds of inorganic fibers may be used together, plural kinds of organic fibers may be used together, and the inorganic fibers and the organic fibers may be used together. Modes of using the plural kinds of inorganic fibers together include, for example, a mode of using carbon fibers and metal fibers together, a mode of using carbon fibers and glass fibers together, and the like. On the other hand, modes of using the plural kinds of organic fibers include, for example, a mode of using polyaramid fibers and fibers constituted by another organic material together, and the like. Further, modes of using the inorganic fibers and the organic fibers together include, for example, a mode of using carbon fibers and polyaramid fibers together.

In an aspect of the present invention, the reinforcing fibers having a tensile strength of 1,000 MPa to 6,000 MPa are used, so that specific examples thereof include carbon fibers, aramid fibers, high-strength polyethylene fibers, polyarylate fibers, glass fibers and steel fibers. Among them, carbon fibers are preferable.

As the carbon fibers, there are generally known acrylonitrile (PAN)-based carbon fibers, petroleum-coal pitch-based carbon fibers, rayon-based carbon fibers, cellulose-based carbon fibers, lignin-based carbon fibers, phenol-based carbon fibers, vapor-grown carbon fibers and the like. In an aspect of the present invention, all of these carbon fibers can be suitably used.

(Carbon Fibers)

The inorganic fibers are preferably used as the reinforcing fibers. The reason for this is that shear is less needed in cutting, because of their relatively low elongation compared to the organic fibers.

Above all, in an aspect of the present invention, acrylonitrile (PAN)-based carbon fibers are preferably used in terms of excellent tensile strength thereof. When the PAN-based carbon fibers are used as the reinforcing fibers, the tensile modulus thereof is preferably within a range of 100 GPa to 600 GPa, more preferably within a range of 200 GPa to 500 GPa, and still more preferably within a range of 230 GPa to 450 GPa. Further, the tensile strength thereof is preferably within a range of 2,000 MPa to 6,000 MPa, and more preferably within a range of 3,000 MPa to 6,000 MPa.

(Fiber Length of Reinforcing Fibers)

The fiber length of the reinforcing fibers used in an aspect of the present invention can be appropriately determined by depending on the kind of reinforcing fibers, the kind of thermoplastic resin, an oriented state of the reinforcing fibers in the composite material and the like, and is not particularly limited. Accordingly, in an aspect of the present invention, either continuous fibers or discontinuous fibers may be used depending on the purpose.

When the discontinuous fibers are used, the average fiber length is usually preferably within a range of 0.1 mm to 500 mm, and more preferably within a range of 1 mm to 100 mm. In an aspect of the present invention, the reinforcing fibers different from each other in fiber length may be used. In other words, the reinforcing fibers used in an aspect of the present invention may have either a single peak or a plurality of peaks in average fiber length.

When the carbon fibers are cut to a constant length with a rotary cutter or the like and used, the cut length thereof corresponds to the average fiber length of the carbon fibers, and this is also the number average fiber length and also the weight average fiber length. Regarding the fiber length of the individual carbon fibers as Li and the number of fibers measured as j, the number average fiber length (Ln) and the weight average fiber length (Lw) are determined by the following formulas (2) and (3). In the case of a constant cut length, the weight average fiber length (Lw) is also calculated by calculation formula (2) of the number average fiber length (Ln)).

$$Ln=\Sigma Li/j \quad \text{formula (2)}$$

$$Lw=(\Sigma Li^2)/(\Sigma Li) \quad \text{formula (3)}$$

The average fiber length measured in an aspect of the present invention may be either the number average fiber length or the weight average fiber length.

(Fiber Diameter of Reinforcing Fibers)

The fiber diameter of the reinforcing fibers used in an aspect of the present invention may be appropriately determined depending on the kind of reinforcing fibers, and is not particularly limited. For example, when the carbon fibers are used as the reinforcing fibers, the average fiber diameter is usually preferably within a range of 3 μm to 50 μm, more preferably within a range of 4 μm to 12 μm, and still more preferably within a range of 5 μm to 8 μm. On the other hand, when the glass fibers are used as the reinforcing fibers, the average fiber diameter is usually preferably within a range of 3 μm to 30 The above-mentioned average fiber diameter as used herein shall be considered to indicate the diameter of a single yarn of the reinforcing fibers. Accordingly, when reinforcing fibers are in a fiber bundle form, it indicates the diameter of the reinforcing fiber (single yarn) constituting the fiber bundle, not the diameter of the fiber bundle. The average fiber diameter of the reinforcing fibers can be measured, for example, by a method described in JIS R7607:2000.

(Fiber Morphology of Reinforcing Fibers)

The reinforcing fibers used in an aspect of the present invention may have either a single fiber form composed of a single yarn or a fiber bundle form constituted by a plurality of single yarns, regardless of the kind thereof.

The reinforcing fibers used in an aspect of the present invention may be only ones having the single fiber form, only ones having the fiber bundle form, or ones in which both are mixed. The fiber bundle shown herein indicates that two or more single yarns come close to each other by a sizing agent, electrostatic force, or the like. When the fiber bundle is used, the number of single yarns constituting each fiber bundle may be almost the same or may be different in each fiber bundle.

When the reinforcing fibers used in an aspect of the present invention are the carbon fibers, and when the carbon fibers have the fiber bundle form, the number of single yarns constituting each fiber bundle is not particularly limited. However, it is usually within a range of 2 to 100,000.

In general, the carbon fibers are in the fiber bundle form in which several thousands to several tens of thousands of filaments are collected together. In the case where the carbon fibers are used as the reinforcing fibers, when the carbon fibers are used as they are, entangled parts of the fiber bundle become locally thick, which sometimes makes it difficult to obtain a thin-walled composite material. For this reason, when the carbon fibers are used as the reinforcing fibers, the fiber bundle is usually widened or opened, and used.

The oriented states of the reinforcing fibers in the fiber-reinforced resin material include, for example, a unidirectional alignment in which long axis directions of the reinforcing fibers are aligned in one direction, and a two-dimensional random orientation in which the above-mentioned long axis directions are randomly oriented in in-plane directions of the fiber-reinforced resin material.

The oriented state of the reinforcing fibers in an aspect of the present invention may be either the above-mentioned unidirectional alignment or the two-dimensional random orientation. Further, it may be a non-regular orientation (an oriented state in which long axis directions of the reinforcing fibers are not aligned completely in one direction and not oriented completely at random) intermediate between the above-mentioned unidirectional alignment and two-dimensional random orientation. Furthermore, depending on the fiber length of the reinforcing fibers, the long axis directions of the reinforcing fibers may be oriented so as to have an angle with respect to the in-plane direction of the fiber-reinforced resin material, or the fibers may be oriented so as to be entangled like cotton. Moreover, the fibers may be oriented like bidirectional woven fabrics such as twilled fabrics and plain-woven fabrics, multiaxial woven fabrics, nonwoven fabrics, mats, knits, braids, paper obtained by papermaking of reinforcing fibers, and the like.

The reinforcing fiber mat in an aspect of the present invention means one in which the reinforcing fibers are stacked or entangled to a mat form. As the reinforcing fiber mat, there is exemplified a two-dimensional random reinforcing fiber mat in which the long axis directions of the reinforcing fibers are oriented randomly in the in-plane direction of the composite material, or a three-dimensional random reinforcing fiber mat in which the reinforcing fibers are entangled like cotton to cause the long axis directions of the reinforcing fibers to be oriented randomly in respective directions X, Y and Z.

Meanwhile, the oriented mode of the reinforcing fibers in the fiber-reinforced resin material can be confirmed, for example, by performing a tensile test based on an arbitrary direction of the fiber-reinforced resin material and a direction perpendicular thereto to measure tensile modulus, and thereafter, measuring the ratio (Eδ) of a larger value of the measured tensile modulus values divided by a smaller value thereof. When the tensile modulus ratio is nearer to 1, the reinforcing fibers can be evaluated to be more two-dimensionally randomly oriented. When the ratio of the larger one of the tensile modulus values in two directions perpendicular to each other divided by the smaller one thereof does not exceed 2, it is evaluated as isotropic. When this ratio does not exceed 1.3, it is evaluated to be excellent in isotropy

[Volume Fraction (Vf) of Reinforcing Fibers in Fiber-Reinforced Resin Material]

With respect to the reinforcing fibers and the thermoplastic resin contained in the fiber-reinforced resin material of an aspect of the present invention, there is no particular limitation on the volume fraction (Vf) of the reinforcing fibers in the fiber-reinforced resin material, which is defined by formula (1). However, it is preferably from 5% to 80%, more preferably from 10% to 80%, still more preferably from 10% to 70%, yet still more preferably from 20% to 50%, and most preferably from 30% to 40%.

$$Vf=100\times\text{reinforcing fiber volume}/(\text{reinforcing fiber volume}+\text{thermoplastic resin volume}) \quad \text{Formula (1)}$$

When the volume fraction (VI) is 5% or more, it becomes easy to sufficiently exert the reinforcing effect. On contrary, when Vf is 80% or less, a void becomes less likely to be formed in the fiber-reinforced resin material, and physical properties thereof tends to be improved.

[Thermoplastic Resin]

The thermoplastic resin used in as aspect of the present invention is not particularly limited, as long as it can provide the composite material having the desired strength, and can be appropriately selected and used depending on the use of the fiber-reinforced resin material and the like.

The above-mentioned thermoplastic resin is not particularly limited, and one having a desired softening point or melting point can be appropriately selected and used depending on the use of the composite material and the like. Usually, one having a softening point within a range of 180° C. to 350° C. is used, but the resin is not limited thereto.

The above-mentioned thermoplastic resins include polyolefin resins, polystyrene resins, thermoplastic polyamide resins, polyester resins, polyacetal resins (polyoxymethylene resins), polycarbonate resins, (meth)acrylic resins, polyarylate resins, polyphenylene ether resins, polyimide resins, polyether nitrile resins, phenoxy resins, polyphenylene sulfide resins, polysulfone resins, polyketone resins, polyether ketone resins, thermoplastic urethane resins, fluororesins, thermoplastic benzimidazole resins, vinyl resins and the like.

The above-mentioned polyolefin resins include, for example, polyethylene resins, polypropylene resins, polybutadiene resins, polymethylpentene resins and the like.

The above-mentioned vinyl resins include, for example, vinyl chloride resins, vinylidene chloride resins, vinyl acetate resins, polyvinyl alcohol resins and the like. The above-mentioned polystyrene resins include, for example, polystyrene resins, acrylonitrile-styrene resins (AS resins), acrylonitrile-butadiene-styrene resins (ABS resins) and the like. The above-mentioned polyamide resins include, for example, polyamide 6 resins (nylon 6), polyamide 11 resins (nylon 11), polyamide 12 resins (nylon 12), polyamide 46 resins (nylon 46), polyamide 66 resins (nylon 66), polyamide 610 resins (nylon 610) and the like. The above-mentioned polyester resins include, for example, polyethylene terephthalate resins, polyethylene naphthalate resins, polybutylene terephthalate resins, polytrimethylene terephthalate resins, liquid crystal polyesters and the like. The above-mentioned (meth)acrylic resins include, for example, polymethyl methacrylate. The above-mentioned polyphenylene ether resins include, for example, modified polyphenylene ether and the like. The above-mentioned thermoplastic polyimide resins include, for example, thermoplastic polyimides, polyamide imide resins, polyether imide resins and the like. The above-mentioned polysulfone resins include, for example, modified polysulfone resins, polyethersulfone resins and the like. The above-mentioned polyether ketone resins include, for example, polyether ketone resins, polyether ether ketone resins and polyether ketone ketone resins. The above-mentioned fluororesins include, for example, polytetrafluoroethylene and the like.

Either one kind or two or more kinds of the thermoplastic resins may be used in an aspect of the present invention. Modes of using two or more kinds of the thermoplastic resins include but are not limited to, for example, a mode of using the thermoplastic resins together which have softening points or melting points different from each other, a mode of using the thermoplastic resins together which have average molecular weights different from each other, and the like.

[Black Pigment]

In the method for producing cut bodies in an aspect of the present invention, it is preferred that the fiber-reinforced resin material contains 0.2 to 20% by weight of a black pigment, and that heating the fiber-reinforced resin material is infrared heating.

When the fiber-reinforced resin material contains 0.2% by weight or more of the black pigment, it is easily heated by infrared rays because infrared rays are well absorbed. Accordingly, the temperature of the fiber-reinforced resin material is rapidly increased, resulting in advantage at the time of mass production. When the amount of the black pigment added is 20% by weight or less, the resin is brought into a state of high viscosity and high thermal conductivity at the time of molding. Thus, flowability at the time of molding is less likely to be reduced, and moldability is less likely to be deteriorated.

The ratio of the black pigment contained in the fiber-reinforced resin material in an aspect of the present invention is more preferably within a range of 0.3% to 10% by weight, and still more preferably within a range of 0.3% to 2% by weight.

Preferred examples of the black pigments include one or more kinds of black pigments selected from the group consisting of carbon black, titanium black, furnace black, acetylene black, lamp black, aniline black, sulfa black and the like, and particularly, the black pigment composed of carbon particles, for example, carbon black, is most preferred.

[Other Agents]

The fiber-reinforced resin material used in an aspect of the present invention may contain additives such as various fibrous or non-fibrous fillers of organic fibers or inorganic fibers, flame retardants, UV resistant agents, stabilizers, mold release agents, pigments, softening agents, plasticizers and surfactants, within a range not impairing the objects of the present invention.

[Method for Producing Fiber-Reinforced Resin Material]

The fiber-reinforced resin material used in an aspect of the present invention can be produced by using a generally known method. For example, an isotropic base material described in WO2012/105080 pamphlet or JP-A-2013-49298 is preferably used. In the fiber-reinforced resin material obtained by using the isotropic base material, the carbon fibers are not aligned in a specific direction in a plane thereof, and arranged in a state dispersed in random directions.

[Cutting Device]

Figure 2:
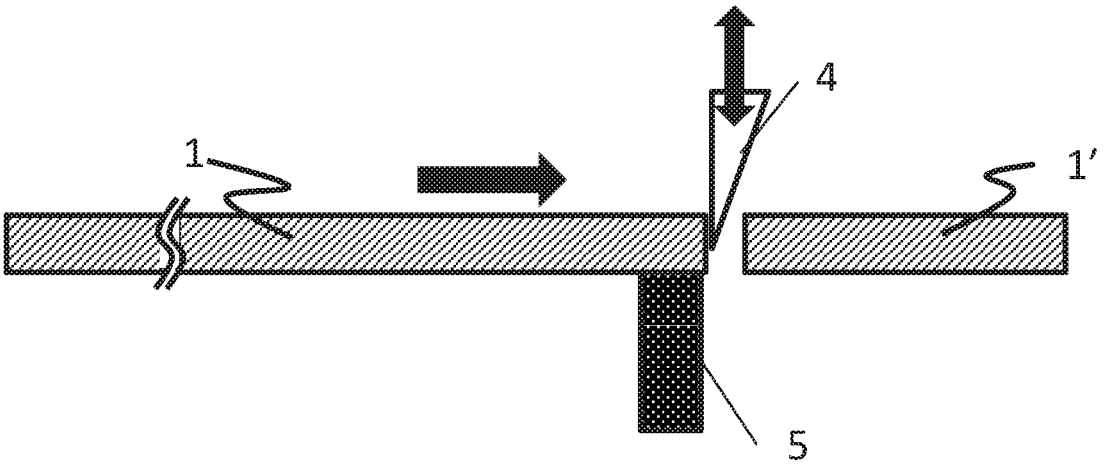
FIG. 2 is a schematic illustration of a method for producing cut bodies using shearing blades in accordance with another aspect.
Figure 3:
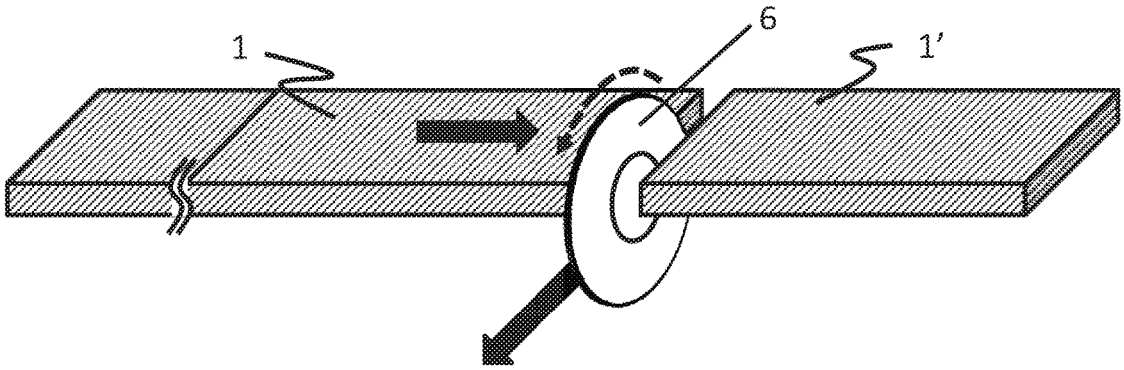
FIG. 3 is a schematic illustration of a method for producing cut bodies using a rotary cutter in accordance with another aspect.
Figure 4:
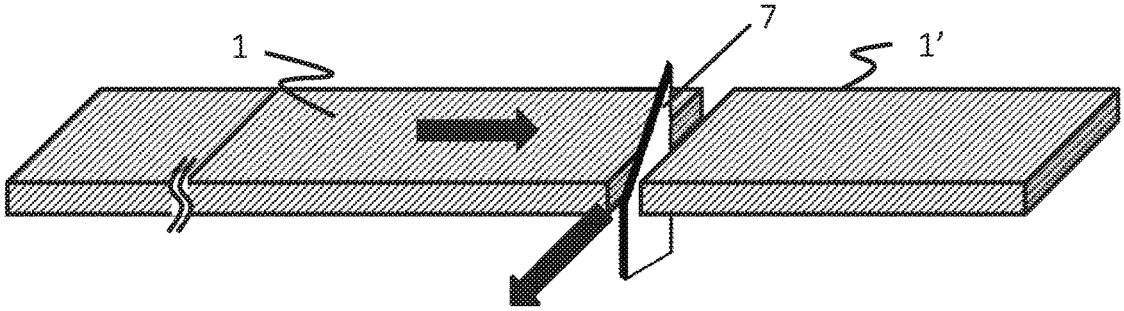
FIG. 4 is a schematic illustration of a method for producing cut bodies using an ultrasonically vibrated knife in accordance with another aspect.

With reference to FIGS. 1-4, examples of techniques for producing a cut material 1' include a method of press cutting a material by placing the material 1 on a conventional cutting table 3 and reciprocating up and down a conventional cutting blade 2 for cutting (FIG. 1), a method of cutting the material by a conventional shearing device by placing the fiber-reinforced resin material 1 between upper 4 and lower 5 blades and cutting it by shearing (FIG. 2), a method of cutting the material 1 by using a conventional rotary cutter 6 (FIG. 3), and a method of cutting the material 1 with a conventional knife 7 ultrasonically vibrated (FIG. 4), and the like. The quality of material, hardness, blade edge shape and the like of the blade 2, 4, 5, 6, 7 to be used can be appropriately selected depending on the characteristics, thickness and the like of the material. However, the hardness is preferably from HS40 to HS98. When the hardness is HS40 or more, wear is less likely to occur by cutting, and durability is good. When the hardness is HS98 or less, toughness is hardly impaired, and defect of the blade 2, 4, 5, 6, 7 and the like become less likely to occur.

[Cutting Table]

In the method for producing cut bodies (and the method for cutting a fiber-reinforced resin material) in an aspect of the present invention, the cut bodies 1' are preferably produced by cutting the fiber-reinforced resin material on a cutting table 3. As the cutting table 3, a known one can be used, and there is no particular limitation, as long as it can support the fiber-reinforced resin material 1. Further, the cutting table 3 in an aspect of the present invention aims at efficient continuous cutting, and does not include a forming mold as described, for example, in JP-A-2011-084038 or JP-A-2013-99817, in which the fiber-reinforced resin material is placed in the forming mold and burrs are removed with a punching blade.

That is, in as aspect of the present invention, trimming of an end material is not performed at the same time as molding, but the fiber-reinforced resin materials are continuously cut to obtain cut bodies 1'.

[Cut Bodies]

The cut bodies 1' in an aspect of the present invention is produced by cutting the fiber-reinforced resin material 1 including the reinforcing fibers having a tensile strength of 1,000 to 6,000 MPa and the thermoplastic resin and produced by decreasing the flexural modulus of the fiber-reinforced resin material to 80% to 15% at the cutting. As the reinforcing fibers, the thermoplastic resin and the other additives contained in the cut bodies, the ones contained in the fiber-reinforced resin material 1 are maintained as they are.

EXAMPLES

Examples are shown below, but the present invention should not be construed as being limited to these. Meanwhile, respective values in these examples were determined by the following methods.

(1) The flexural modulus of the fiber-reinforced resin material was determined by measurement according to a manner of JIS K7074: 1988.

(2) For measurement of the average fiber length of the reinforcing fibers, the fiber-reinforced resin material was heated at 500° C. under the atmosphere to remove the resin, the fiber lengths of 300 fibers randomly selected from the remaining sample were measured to mm unit with a caliper, and the average thereof was determined.

(3) Life of Cutting Blade

The fiber-reinforced resin materials described in respective Reference Examples, Examples and Comparative Examples were cut until the occurrence of a cutting failure, and evaluation was performed by counting the number of cutting times until the occurrence of the cutting failure.

Reference Example 1

Using, as reinforcing fibers, carbon fibers "Tenax" (registered trade mark) STS40-24KS (average fiber diameter: 7 μm) manufactured by TOHO TENAX Co., Ltd., treated with a nylon-based sizing agent, and, as a thermoplastic resin, a nylon 6 resin A1030 manufactured by UNITIKA Ltd., an isotropic material having a carbon fiber areal weight of 1,800 g/m$^2$ and a nylon resin areal weight of 1,500 g/m$^2$ was prepared based on the method described in WO2012/105080 pamphlet, and after preheating at 240° C. for 90 seconds, it was hot pressed at 240° C. for 180 seconds while applying a pressure of 2.0 MPa. Then, it was cooled to 50° C. in the pressurized state to obtain a flat plate of a carbon fiber composite material having a thickness of 2 mm and a volume fraction Vf of 43%. This was taken as fiber-reinforced resin material 1.

Reference Example 1-2

A fiber-reinforced resin material was prepared in the same manner as in Reference Example 1 with the exception that when fiber-reinforced resin material 1 was prepared, carbon black was allowed to be contained previously in the nylon 6 resin so as to be contained in an amount of 0.5% by weight based on the fiber-reinforced resin material. This was taken as fiber-reinforced resin material 1-2.

Reference Example 1-3

A fiber-reinforced resin material was prepared in the same manner as in Reference Example 1 with the exception that when fiber-reinforced resin material 1 was prepared, a polycarbonate (manufactured by TEIJIN LIMITED: L-1225Y) was used in place of the nylon 6 resin A1030 manufactured by UNITIKA Ltd. This was taken as fiber-reinforced resin material 1-3.

Reference Example 1-4

A fiber-reinforced resin material was prepared in the same manner as in Reference Example 1 with the exception that when fiber-reinforced resin material 1 was prepared, the carbon fiber areal weight and the nylon resin areal weight were adjusted so as to give a volume fraction Vf of 30%. This was taken as fiber-reinforced resin material 1-4.

Reference Example 1-5

A fiber-reinforced resin material was prepared in the same manner as in Reference Example 1 with the exception that when fiber-reinforced resin material 1 was prepared, the carbon fiber areal weight and the nylon resin areal weight were adjusted so as to give a volume fraction Vf of 40%. This was taken as fiber-reinforced resin material 1-5.

Reference Example 2

Using, as reinforcing fibers, carbon fibers "Tenax" (registered trade mark) HTC 110 (average fiber diameter: 7 μm, fiber length: 6 mm) manufactured by TOHO TENAX Co., Ltd., a papermaking base material is prepared by the method described in JP-A-2014-095034.

Specifically, a dispersion with a concentration of 0.1% by weight constituted by water and a surfactant (polyoxyethylene lauryl ether) is prepared, and using this dispersion and the above-mentioned chopped carbon fibers, the papermaking base material is prepared with a papermaking base material production apparatus. The composite material obtained has a width of 500 mm, a length of 500 mm and a fiber areal weight of 180 g/m$^2$.

Ten sheets of the above-mentioned papermaking base materials are layered with the predetermined number of polyamide films (manufactured by UNITIKA Ltd., Emblem, thickness: 15 μm) sandwiched therebetween, and after preheating at 240° C. for 90 seconds, they are hot pressed at 240° C. for 180 seconds while applying a pressure of 2.0 MPa. Then, they are cooled to 50° C. in the pressurized state to obtain a flat plate of a carbon fiber composite material having a thickness of 2 mm and a volume fraction Vf of 43%. This is taken as fiber-reinforced resin material 2.

Reference Example 3

Carbon fibers (manufactured by TOHO TENAX Co., Ltd., tensile strength: 4,200 MPa) having a fiber diameter of 12 μm are cut to 35 mm, and the cut carbon fiber bundles and nylon 6 short fibers (short fiber tex: 1.7 dtex, cut length: 51 mm, the number of crimps: 12 crimps/25 mm, percentage of crimp: 15%) are mixed in a weight ratio of 90:10, and introduced into a carding apparatus. A web discharged is cloth wrapped to form a sheet-like carbon fiber assembly with a fiber areal weight of 100 g/cm$^2$ which are constituted by the carbon fibers and the nylon 6 fibers.

Assuming a winding direction of the sheet-like carbon fiber assembly as 0°, 12 sheets of the carbon fiber assemblies are stacked so as to become)(0°/90°/0°/90°/0°/90°, and further, the whole stacked carbon fiber assemblies are sandwiched between stainless steel plates in a state where the predetermined number of polyamide films (manufactured by UNITIKA Ltd., Emblem, thickness: 15 μm) are sandwiched between the carbon fiber assemblies. After preheating at 240° C. for 90 seconds, they are hot pressed at 240° C. for 180 seconds while applying a pressure of 2.0 MPa. Then, they are cooled to 50° C. in the pressurized state to obtain a flat plate of a carbon fiber composite material having a thickness of 2 mm and a volume fraction Vf of 43%. This is taken as fiber-reinforced resin material 3.

Example 1

Fiber-reinforced resin material 1 was heated at 100° C. in an infrared heating furnace, and cut with a cutting blade NCD12 manufactured by Osaka Nukigata Seisakusho Co., ltd., which was mounted on a servo press, under conditions of a blade lowering speed of 100 spm and an applied pressure of 2 tons to produce cut bodies. The flexural modulus of the fiber-reinforced resin material at 100° C. was 20 GPa, which was 70% of that at ordinary temperature. Further, the number of cutting times until the occurrence of the cutting failure was 85. The results thereof are shown in Table 1.

Example 2

Cut bodies were produced by cutting fiber-reinforced resin material 1 in the same manner as in Example 1 with the exception that fiber-reinforced resin material 1 was heated at 150° C. in the infrared heating furnace. The flexural modulus of the fiber-reinforced resin material at 150° C. was 18 GPa, which was 63% of that at ordinary temperature. Further, the number of cutting times until the occurrence of the cutting failure was 113. The results thereof are shown in Table 1.

Example 3

Cut bodies were produced by cutting fiber-reinforced resin material 1 in the same manner as in Example 1 with the exception that fiber-reinforced resin material 1 was heated at 180° C. in the infrared heating furnace. The flexural modulus of the fiber-reinforced resin material at 180° C. was 12 GPa, which was 42% of that at ordinary temperature. Further, the number of cutting times until the occurrence of the cutting failure was 185. The results thereof are shown in Table 1.

Example 4

Cut bodies were produced by cutting fiber-reinforced resin material 1-2 in the same manner as in Example 1 with the exception that fiber-reinforced resin material 1-2 was used in which when fiber-reinforced resin material 1 was prepared, carbon black was allowed to be contained previously in the nylon 6 resin so as to be contained in an amount of 0.5% by weight based on the fiber-reinforced resin material. The time until the fiber-reinforced resin material 1-2 reached 100° C. in the infrared heating furnace was shorter than in Example 1, and heating can be performed in a time shorter by about 10%. Further, the number of cutting times until the occurrence of the cutting failure was 86. The results thereof are shown in Table 1.

Example 5

Cut bodies are produced by cutting fiber-reinforced resin material 2 in the same manner as in Example 1 with the exceptions that fiber-reinforced resin material 2 is used in place of fiber-reinforced resin material 1, and that the heating temperature of the fiber-reinforced resin material is changed to 150° C. The number of cutting times until the occurrence of the cutting failure is 133. The results thereof are shown in Table 1.

Example 6

Cut bodies are produced by cutting fiber-reinforced resin material 3 in the same manner as in Example 1 with the exceptions that fiber-reinforced resin material 3 is used in place of fiber-reinforced resin material 1 and that the heating temperature of the fiber-reinforced resin material is changed to 150° C. The number of cutting times until the occurrence of the cutting failure is 107. The results thereof are shown in Table 1.

Example 7

Cut bodies were produced by cutting fiber-reinforced resin material 1-3 in the same manner as in Example 1 with the exceptions that fiber-reinforced resin material 1-3 was used in which when fiber-reinforced resin material 1 was prepared, a polycarbonate (manufactured by TEIJIN LIMITED: L-1225Y) was used in place of the nylon 6 resin A1030 manufactured by UNITIKA Ltd., and that the heating temperature of the fiber-reinforced resin material was changed to 145° C. The number of cutting times until the occurrence of the cutting failure was 102. The results thereof are shown in Table 1.

Example 8

Fiber-reinforced resin material 1-4 prepared by adjusting the volume fraction Vf to 30% was humidity-controlled to allow the polyamide to absorb moisture to a moisture content of 3.5%. The flexural modulus after absorption was 19.4 GPa, which was 79% of that before absorption. As a result of operation under the same cutting conditions as in Example 1, the number of cutting times until the occurrence of the cutting failure was 79. The results thereof are shown in Table 2.

Example 9

Fiber-reinforced resin material 4 was prepared in the same manner as in Reference Example 3 with the exception that glass fibers (Nitto Boseki Co., Ltd., E-glass Yarn ECG, fiber diameter: 9.1 the number of filaments: 800) were used as reinforcing fibers.

Fiber-reinforced resin material 4 was cut in the same manner as in Example 6 to produce cut bodies. The number of cutting times until the occurrence of the cutting failure was 192.

Example 10

Nylon 6 in a molten state, which was discharged from a molten resin discharge mold, and the discharged amount of which was adjusted so as to give a volume fraction Vf of 50%, was placed on both surfaces of a unidirectional carbon fiber sheet wound off from a creel, and the carbon fiber sheet and the thermoplastic resin were integrated.

Subsequently, they were introduced into a double belt press apparatus, and the unidirectional carbon fiber sheet was allowed to be impregnated with the thermoplastic resin. After passing through the double belt press apparatus, the sample temperature was decreased to a temperature equivalent to or lower than the melting point of the thermoplastic resin by cooling to obtain fiber-reinforced resin material 5 having a thickness of 1 mm.

Fiber-reinforced resin material 5 was heated at 190° C. in the infrared heating furnace, and cut in the same manner as in Example 1 to produce cut bodies. The flexural modulus of the fiber-reinforced resin material at 190° C. was 15 GPa, which was 15% of that at ordinary temperature. Further, the number of cutting times until the occurrence of the cutting failure was 83.

Comparative Example 1

Fiber-reinforced resin material 1 was cut in the same manner as in Example 1 with the exception that the fiber-reinforced resin material was cut at 75° C. The flexural modulus of the fiber-reinforced resin material at 75° C. was 25.7 GPa, which was 90% of that at ordinary temperature.

The number of cutting times until the occurrence of the cutting failure was 42. The results thereof are shown in Table 1.

Comparative Example 2

Fiber-reinforced resin material 1 was cut in the same manner as in Example 1 with the exception that the fiber-reinforced resin material was cut at 40° C. The number of cutting times until the occurrence of the cutting failure was 12. The results thereof are shown in Table 1.

Comparative Example 3

Fiber-reinforced resin material 1 was cut in the same manner as in Example 1 with the exception that the fiber-reinforced resin material was cut at 220° C. The flexural modulus was largely decreased, resulting in a failure of cutting because of its excessive softness. The results thereof are shown in Table 1.

Comparative Example 4

Fiber-reinforced resin material 1-5 were cut in the same manner as in Example 8 with the exception that fiber-reinforced resin material 1-5 prepared so as to have a volume fraction Vf of 40% was used. The results thereof are shown in Table 2.

TABLE 1

| | Example 1 | Example 2 | Example 3 | Example 4 | Example 5 | Example 6 |
|---|---|---|---|---|---|---|
| Fiber-Reinforced Resin Material | | | | | | |
| Kind | Fiber-reinforced resin material 1 | Fiber-reinforced resin material 1 | Fiber-reinforced resin material 1 | Fiber-einforced resin material 1-2 | Fiber-reinforced resin material 2 | Fiber-reinforced resin material 3 |
| Thermoplastic Resin | Nylon 6 | Nylon 6 | Nylon 6 | Nylon 6 | Nylon 6 | Nylon 6 |
| Reinforcing Fibers | Carbon fibers | Carbon fibers | Carbon fibers | Carbon fibers | Carbon fibers | Carbon fibers |
| Carbon Black (weight ratio (%) based on fiber-reinforced resin material) | 0 | 0 | 0 | 0.5 | 0 | 0 |
| Flexural modulus GPa at Ordinary Temperature | 28.6 | 28.6 | 28.6 | 28.6 | 30.8 | 30.2 |
| Heating of Fiber-reinforced resin material | | | | | | |
| Flexural modulus GPa after Heating | 20 | 18 | 12 | 20 | 20 | 19 |
| Decrease Ratio (%) of Flexural modulus (Flexural modulus after heating/flexural modulus at ordinary temperature × 100) | 70% | 63% | 42% | 70% | 65% | 63% |
| Heating Temperature of Fiber-Reinforced Resin Material | 100 | 150 | 180 | 100 | 150 | 150 |
| Evaluation | | | | | | |
| Number of Cutting Times until Occurrence of Cutting Failure | 85 | 113 | 185 | 86 | 133 | 107 |

| | Example 7 | Comparative Example 1 | Comparative Example 2 | Comparative Example 3 |
|---|---|---|---|---|
| Fiber-Reinforced Resin Material | | | | |
| Kind | Fiber-reinforced resin material 1-3 | Fiber-reinforced resin material 1 | Fiber-reinforced resin material 1 | Fiber-reinforced resin material 1 |
| Thermoplastic Resin | Polycarbonate | Nylon 6 | Nylon 6 | Nylon 6 |
| Reinforcing Fibers | Carbon fibers | Carbon fibers | Carbon fibers | Carbon fibers |
| Carbon Black (weight ratio (%) based on fiber-reinforced resin material) | 0 | 0 | 0 | 0 |
| Flexural modulus GPa at Ordinary Temperature | 31.0 | 28.6 | 28.6 | 28.6 |
| Heating of Fiber-reinforced resin material | | | | |
| Flexural modulus GPa after Heating | 20 | 25.7 | 27.5 | 3.7 |
| Decrease Ratio (%) of Flexural modulus (Flexural modulus after heating/flexural modulus at ordinary temperature × 100) | 65% | 90% | 96% | 13% |

TABLE 1-continued

| | | | | |
|---|---|---|---|---|
| Heating Temperature of Fiber-Reinforced Resin Material | 145 | 75 | 40 | 220 |
| Evaluation | | | | |
| Number of Cutting Times until Occurrence of Cutting Failure | 102 | 42 | 12 | Uncuttable |

TABLE 2

| | Example 8 | Comparative Example 4 |
|---|---|---|
| Fiber-Reinforced Resin Material | | |
| Kind | Fiber-reinforced resin material 1-4 | Fiber-reinforced resin material 1-5 |
| Thermoplastic Resin | Nylon 6 | Nylon 6 |
| Reinforcing Fibers | Carbon fibers | Carbon fibers |
| Volume Fraction (Vf) | 30% | 40% |
| Flexural modulus GPa at 23° C. in Drying | 24.6 | 26.9 |
| Humidity Control of Fiber-Reinforced Resin Material | | |
| Flexural modulus GPa after Humidity Control | 19.4 | 23.3 |
| Decrease Ratio (%) of Flexural modulus (Flexural modulus after humidity control/flexural modulus in drying × 100) | 79% | 87% |
| Moisture Contained in Polyamide | 3.5% | 3.5% |
| Evaluation | | |
| Number of Cutting Times until Occurrence of Cutting Failure | 79 | 40 |

TABLE 3

| | Example 9 | Example 10 |
|---|---|---|
| Fiber-Reinforced Resin Material | | |
| Kind | Fiber-reinforced resin material 4 | Fiber-reinforced resin material 5 |
| Thermoplastic Resin | Nylon 6 | Nylon 6 |
| Reinforcing Fibers | Glass fibers | Carbon fibers (unidirectional carbon fiber sheet) |
| Carbon Black (weight ratio (%) based on fiber-reinforced resin material) | 0 | 0 |
| Flexural modulus GPa at Ordinary Temperature | 12.0 | 100 |
| Heating of Fiber-Reinforced Resin Material | | |
| Flexural modulus GPa after Heating | 7.5 | 15 |
| Decrease Ratio (%) of Flexural modulus (Flexural modulus after heating/flexural modulus at ordinary temperature × 100) | 63% | 15% |
| Heating Temperature of Fiber-Reinforced Resin Material | 150 | 190 |
| Evaluation | | |
| Number of Cutting Times until Occurrence of Cutting Failure | 192 | 83 |

INDUSTRIAL APPLICABILITY

A method for producing cut bodies and a method for cutting a fiber-reinforced resin material of the present invention make it possible to achieve excellent durability of a cutting blade, are suitable for mass production of structural parts and the like of automobiles and the like, and make sure reduction in vehicle body weight and the like.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A method for producing cut bodies of a fiber-reinforced resin material, the material including reinforcing fibers having a tensile strength of 1,000 MPa to 6,000 MPa and a thermoplastic resin, the method comprising:

decreasing a flexural modulus of the fiber-reinforced resin material to a value ranging from 80% to 15% of the flexural modulus of the fiber-reinforced resin material before heating by heating the fiber-reinforced resin material to a temperature ranging from 150° C. lower than a melting point of the thermoplastic resin to 50° C. lower than the melting point of the thermoplastic resin when the thermoplastic resin is a crystalline resin, or to a temperature ranging from 50° C. lower than a glass transition point of the thermoplastic resin to 50° C. higher than the glass transition point of the thermoplastic resin when the thermoplastic resin is an amorphous resin; and cutting the heated fiber-reinforced resin material having the decreased flexural modulus to produce the cut bodies;

wherein the reinforcing fibers are carbon fibers, have an average fiber length of 1 mm to 100 mm, and are randomly oriented in in-plane directions of the fiber-reinforced resin material.

2. The method for producing cut bodies according to claim 1, wherein the cutting is performed on a cutting table.

3. The method for producing cut bodies according to claim 1, wherein the fiber-reinforced resin material contains 0.2 to 20% by weight of a black pigment, and the heating the fiber-reinforced resin material is performed by infrared heating.

4. The method for producing cut bodies according to claim 1, wherein a temperature of the fiber-reinforced resin material at the cutting is substantially constant.

5. The method for producing cut bodies according to claim 1, wherein at least a part of the reinforcing fibers is a fiber bundle form.

6. The method for producing cut bodies according to claim 1, wherein a volume fraction (Vf) of the reinforcing fibers in the fiber-reinforced resin material is from 5% to 80%, and wherein $Vf$=100×reinforcing fiber volume/(reinforcing fiber volume+thermoplastic resin volume).

7. The method for producing cut bodies according to claim 1, wherein a volume fraction (Vf) of the reinforcing fibers in the fiber-reinforced resin material is from 20% to 50%, and wherein $Vf$=100×reinforcing fiber volume/(reinforcing fiber volume+thermoplastic resin volume).

8. A method for cutting a fiber-reinforced resin material, the material including reinforcing fibers having a tensile strength of 1,000 MPa to 6,000 MPa and a thermoplastic resin, the method comprising:

decreasing a flexural modulus of the fiber-reinforced resin material to a value ranging from 80% to 15% of the flexural modulus of the fiber-reinforced resin material before heating by heating the fiber-reinforced resin material to a temperature ranging from 150° C. lower than a melting point of the thermoplastic resin to 50° C. lower than the melting point of the thermoplastic resin when the thermoplastic resin is a crystalline resin, or to a temperature ranging from 50° C. lower than a glass transition point of the thermoplastic resin to 50° C. higher than the glass transition point of the thermoplastic resin when the thermoplastic resin is an amorphous resin; and cutting the heated fiber-reinforced resin material having the decreased flexural modulus to form a cut body;

wherein the reinforcing fibers are carbon fibers, have an average fiber length of 1 mm to 100 mm, and are randomly oriented in in-plane directions of the fiber-reinforced resin material.

* * * * *